US005345295A

United States Patent [19]

Takano et al.

[11] Patent Number: 5,345,295

[45] Date of Patent: Sep. 6, 1994

[54] POSITIONING MEMBER FOR A SEPARATION ELECTRODE MOUNTED ON A CLAMSHELL-TYPE COPIER

[75] Inventors: Minoru Takano; Akihiro Komuro; Mitsuru Yamazaki, all of Kawasaki, Japan

[73] Assignee: Fujitsu Limited, Kawasaki, Japan

[21] Appl. No.: 103,782

[22] Filed: Aug. 10, 1993

[30] Foreign Application Priority Data

Sep. 28, 1992 [JP] Japan ..... 4-257920

[51] Int. Cl.[5] ..... G03G 15/00

[52] U.S. Cl. ..... 355/200; 355/210; 355/315

[58] Field of Search ..... 355/200, 210, 315, 274; 271/900

[56] References Cited

U.S. PATENT DOCUMENTS

| | | | |
|---|---|---|---|
| 4,699,499 | 10/1987 | Hoshika et al. | 271/900 X |
| 4,739,363 | 4/1988 | Hoshika et al. | 355/274 |
| 4,875,077 | 10/1989 | Takamatsu et al. | 355/271 |
| 5,047,801 | 9/1991 | Haneda et al. | 355/200 |
| 5,105,221 | 4/1992 | Takahashi et al. | 355/210 |
| 5,132,654 | 7/1992 | Walgrove, III et al. | 355/274 |
| 5,160,963 | 11/1992 | Haneda et al. | 355/200 |

FOREIGN PATENT DOCUMENTS 1-302369 12/1989 Japan .

*Primary Examiner*—A. T. Grimley
*Assistant Examiner*—Nestor R. Ramirez
*Attorney, Agent, or Firm*—Staas & Halsey

[57] ABSTRACT

Disclosed is an image forming apparatus in which separation unit for electrostatically separating a sheet from a latent image carrier is provided on an openable and closable frame. This image forming apparatus comprises a feeding path for feeding a sheet on which an image is to be formed; an endless latent image carrier; image forming unit for forming a toner image on the latent image carrier; transfer unit for transferring the toner image on the latent image carrier onto the sheet that is conveyed in the feeding path; separation unit for supplying electric charges of an opposite polarity to that of electric charges on a back of the sheet to the back of the sheet in the feeding path at a position downstream of the transfer unit, thereby separating the sheet from the latent image carrier; an openable and closable frame on which at least the separation unit is movably provided and which is to be opened to free the feeding path; a main body frame on which at least the latent image carrier is provided; and a positioning member, provided on the main body frame, for positionin the separation unit by engagement with the separation unit when the frame is closed. With this structure, even when the frame is open or closed, the precision of the position of the separation unit with respect to the latent image carrier can be improved, thus ensuring stable sheet separation.

30 Claims, 11 Drawing Sheets

POSITIONING MEMBER FOR A SEPARATION ELECTRODE MOUNTED ON A CLAMSHELL-TYPE COPIER

BACKGROUND OF THE INVENTION

Field of the Invention

The present invention relates to an image forming apparatus which transfers a toner image on a latent image carrier, such as a photosensitive drum, onto a sheet to thereby form an image on this sheet, and, more particularly, to an image forming apparatus which has separation means for electrically separating the sheet from a latent image carrier after image transfer.

Description of the Related Art

Image forming apparatuses, such as a copying machine, a printer and a facsimile, employ a latent image forming type recording apparatus like an electrophotographing apparatus, due to a recent demand for image recording on normal sheets of paper. According to this image forming principle, after a photosensitive drum as a latent image carrier is precharged, the photosensitive drum is exposed to a light image to have an electrostatic latent image formed thereon. This electrostatic latent image is developed by a developing unit so that a toner image is formed on the photosensitive drum. This toner image is then transferred onto a sheet of paper.

In the image transfer on the sheet, the sheet will electrostatically stick on the photosensitive drum, so that the sheet should be separated from the drum. Accordingly, a separator for separating the sheet from the drum is provided above the sheet feeding path and downstream of the transfer unit. This sheet separator supplies, to the back of the sheet, electric charges of the opposite polarity to that of the electric charges on the back of the sheet to cause the electrostatic forces of the sheet and the photosensitive drum to cancel out each other, thus separating the sheet from the drum.

To ensure a stable separation operation of the separator, this type of apparatus requires that the distances between the separator (particularly, the discharging portion of the separator) and the photosensitive drum and the transfer unit, and the positions of those units be maintained precisely.

FIG. 1 is an exemplary diagram of prior art. As shown in FIG. 1, in an electrophotographing apparatus, for example, after a photosensitive drum 90 is precharged by a precharger 91, image light is irradiated on the drum 90 to form an electrostatic latent image thereon. The electrostatic latent image is developed with a toner in a developing unit 92, thus forming a toner image on the photosensitive drum 90. A transfer unit 93 supplies electric charges of the opposite polarity to that of the electric charges of the toner image on the photosensitive drum 90, to the back of a sheet of paper to thereby transfer the toner image on the drum 90 onto the sheet. The supply of the electric charges of the opposite polarity to the back of the sheet causes the sheet to electrostatically stick on the photosensitive drum 90, thus ensuring good transfer of the toner image.

The stuck sheet will not be separated from the photosensitive drum 90, if left intact in this condition, but should be separated therefrom for the subsequent process. To do so, a separator 94 constituted of a discharge member, such as a corotron or discharge electrode, is provided in the sheet feeding path at the downstream of the transfer unit 93. This separator 94 removes the electric charges from the back of the sheet to cancel out the electrostatic attraction forces of the photosensitive drum 90 and the sheet each other, thus separating the sheet from the drum 90. There are two types of separators 94: the first type grounds the back of the sheet to remove the electric charges from the back of the sheet and the second one supplies, to the back of the sheet, electric charges of the opposite polarity to that of the electric charges on the back of the sheet, thereby removing the electric charges from the back of the sheet.

In such an electrophotographing apparatus, the sheet feeding path should be freed in view of the possible removal of a jammed sheet and the maintenance of the apparatus. Accordingly, the transfer unit 93 and separator 94 are provided on a frame 95 and this frame 95 is opened to free the sheet feeding path. As the separator 94 is fixed to the frame 95, the precision of the position of the separator 94 with respect to the photosensitive drum 90 is determined by the precision of the position of the frame 95 with respect to the apparatus body.

As the frame 95 is allowed for a predetermined size error, the gap between the separator 94 and the latent image carrier 90 differs from one apparatus to another due to this size error. When a high bias voltage is applied to the separator 94, therefore, the variation in gap causes the separator 94 to be short-circuited or perform insufficient discharge. to reduce the size error of the frame 95, the frame 95 should be designed rigid and higher position accuracy should be provided. This increases the weight as well as the cost.

SUMMARY OF THE INVENTION

It is therefore a primary object of the present invention to provide an image forming apparatus which, even with a separator provided on a frame, can permit the separator to perform a stable separation operation.

It is another object of the present invention to provide an image forming apparatus which, even with a separator provided on a frame, can ensure a high precision of the gap between a latent image carrier and the separator.

It is a further object of the present invention to provide an image forming apparatus which can improve the precision of the gap between a latent image carrier and a separator with a simple structure.

It is a still further object of the present invention to provide an image forming apparatus which can improve the positional precisions of a latent image carrier, a separator and a transfer unit to thereby ensure stable image transfer and sheet separation.

To achieve the foregoing and other objects and in accordance with the purpose of the present invention, an image forming apparatus according to the present invention comprises a feeding path for feeding a sheet on which an image is to be formed; an endless latent image carrier; image forming means for forming a toner image on the latent image carrier; transfer means for transferring the toner image on the latent image carrier onto the sheet that is conveyed in the feeding path; separation means for supplying electric charges of an opposite polarity to that of electric charges on a back of the sheet to the back of the sheet in the feeding path at a position downstream of the transfer means, thereby separating the sheet from the latent image carrier; an openable and closable frame on which at least the separation means is movably provided and which is to be opened to free the feeding path; a main body frame on which at least the latent image carrier is provided; and a positioning member, provided on the main body frame, for positioning the separation means by engagement with the separation means when the frame is closed.

With the above structure, the separation means is movably provided on the frame and the positioning member is provided on the main body frame where the latent image carrier is provided. The separation means is therefore positioned by the positioning member on the main body frame, so that a constant positional relationship between the latent image carrier on the main body frame and the separation means can be maintained. This can ensure a stable separation operation of the separation means. In particular, since the positional precision between the latent image carrier and the positioning member can be maintained within an allowance of about 0.05 mm, the precision of the gap between the latent image carrier and the separation means can be improved significantly. Further, even if the frame is made of plastic or the like, which does not have a high size precision and is inexpensive, this gap precision can be increased. It is therefore possible to provide a low-cost and light image forming apparatus.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENT

Figure 1:
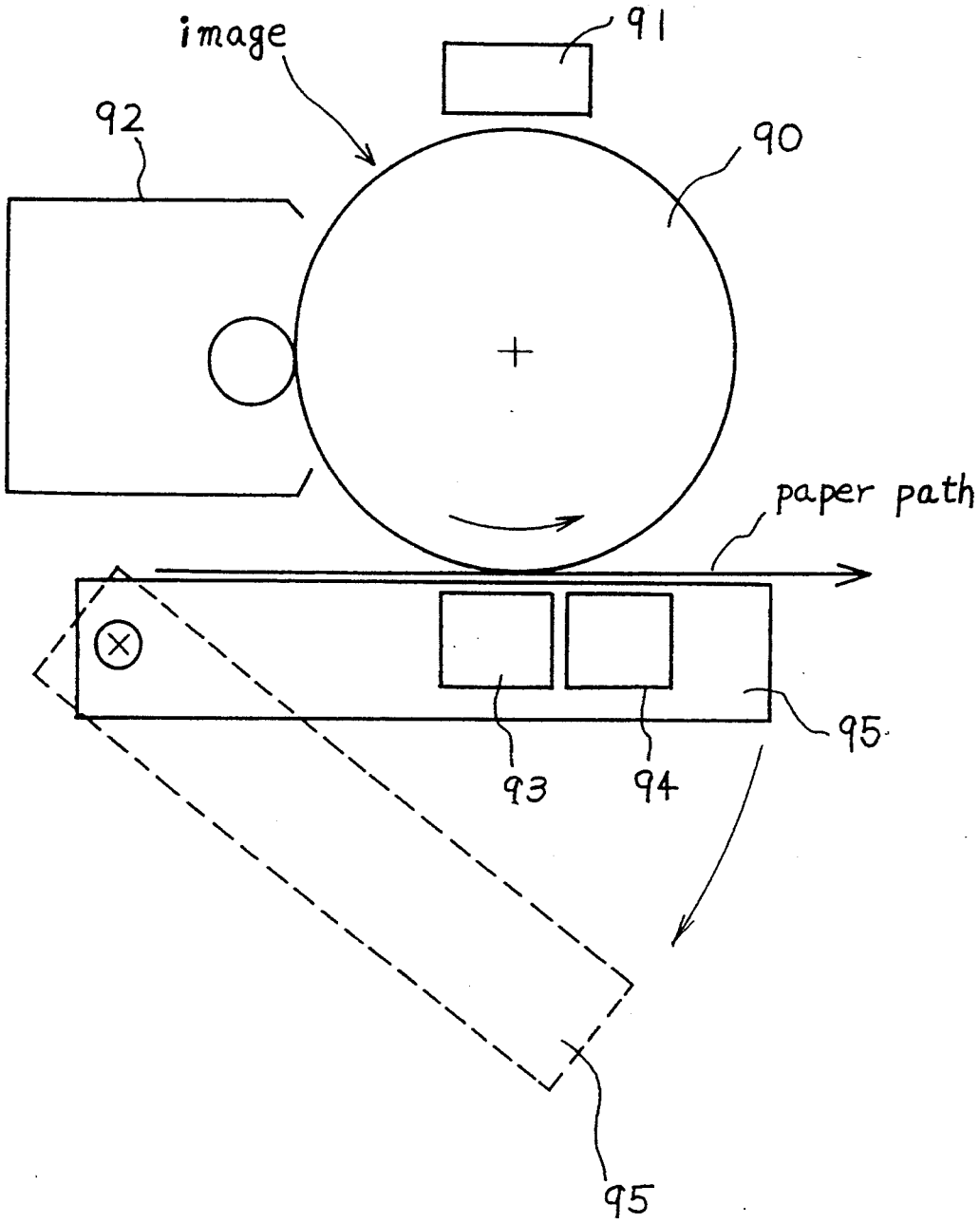
FIG. 1 PRIOR ART
FIG. 1 is an explanatory diagram of prior art.
Figure 2:
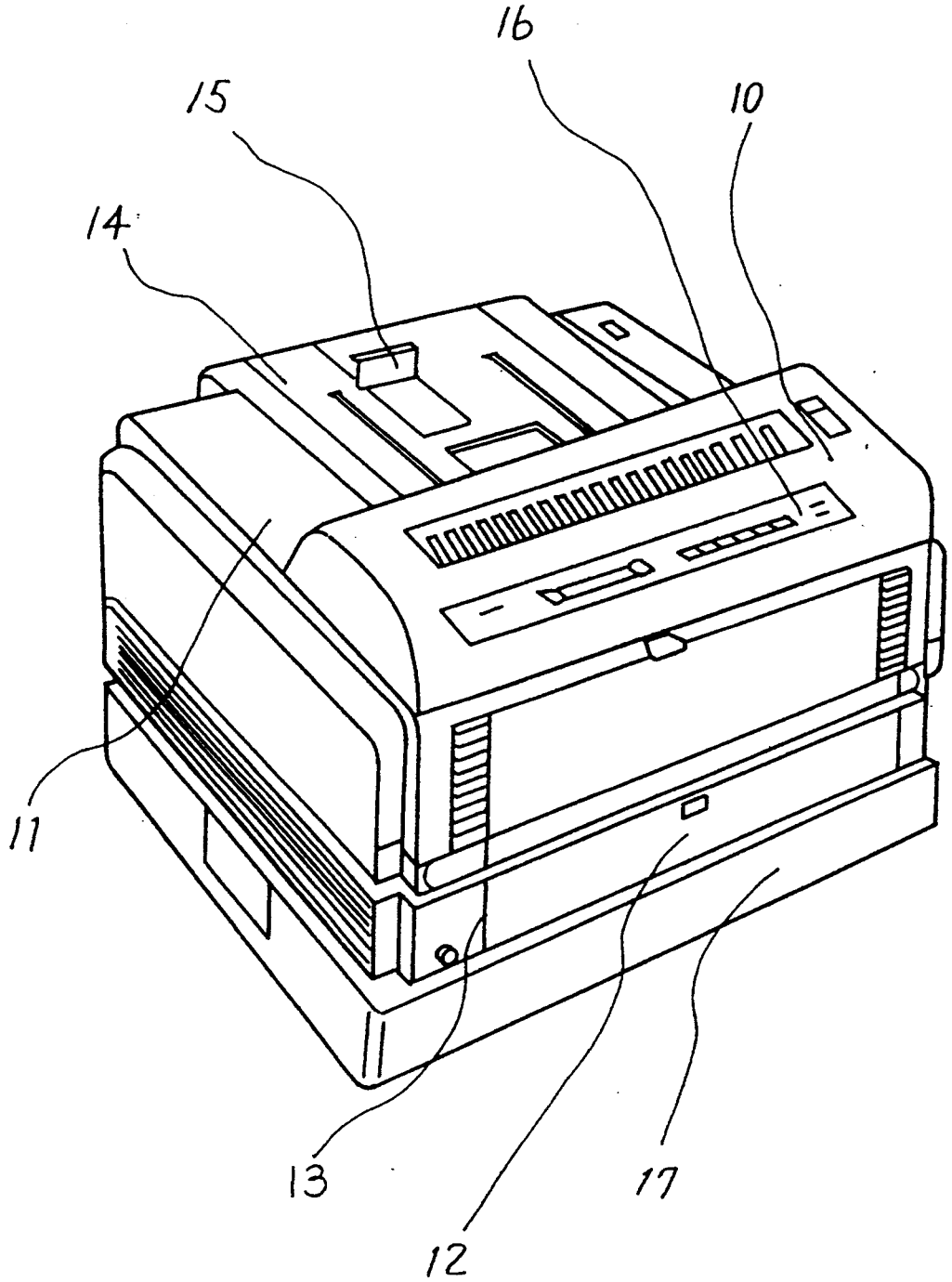
FIG. 2 is a perspective view showing the outline of an image forming apparatus according to one embodiment of the present invention.
Figure 3:
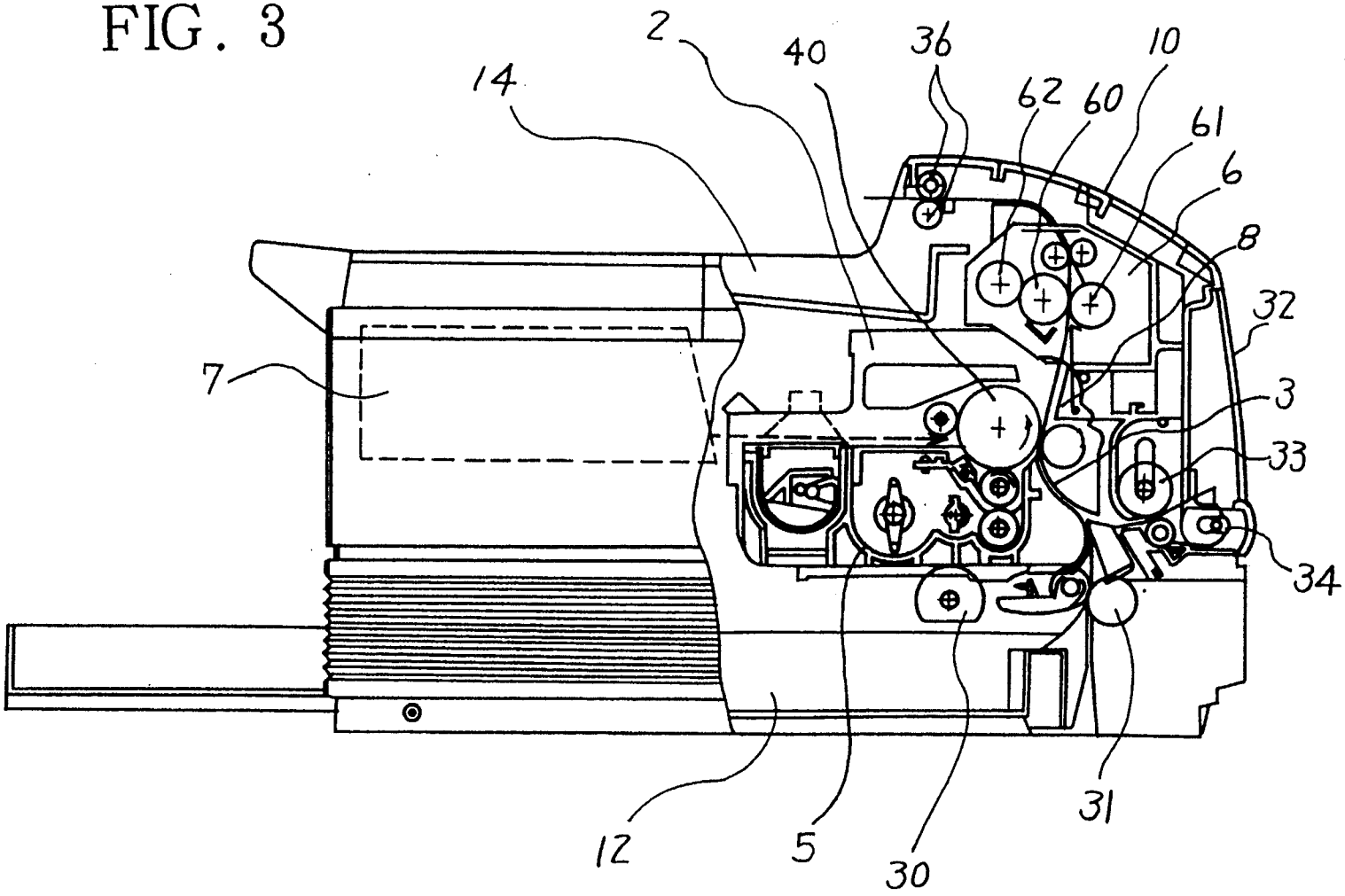
FIG. 3 is a cross-sectional view showing the interior of the image forming apparatus shown in FIG. 2.
Figure 4:
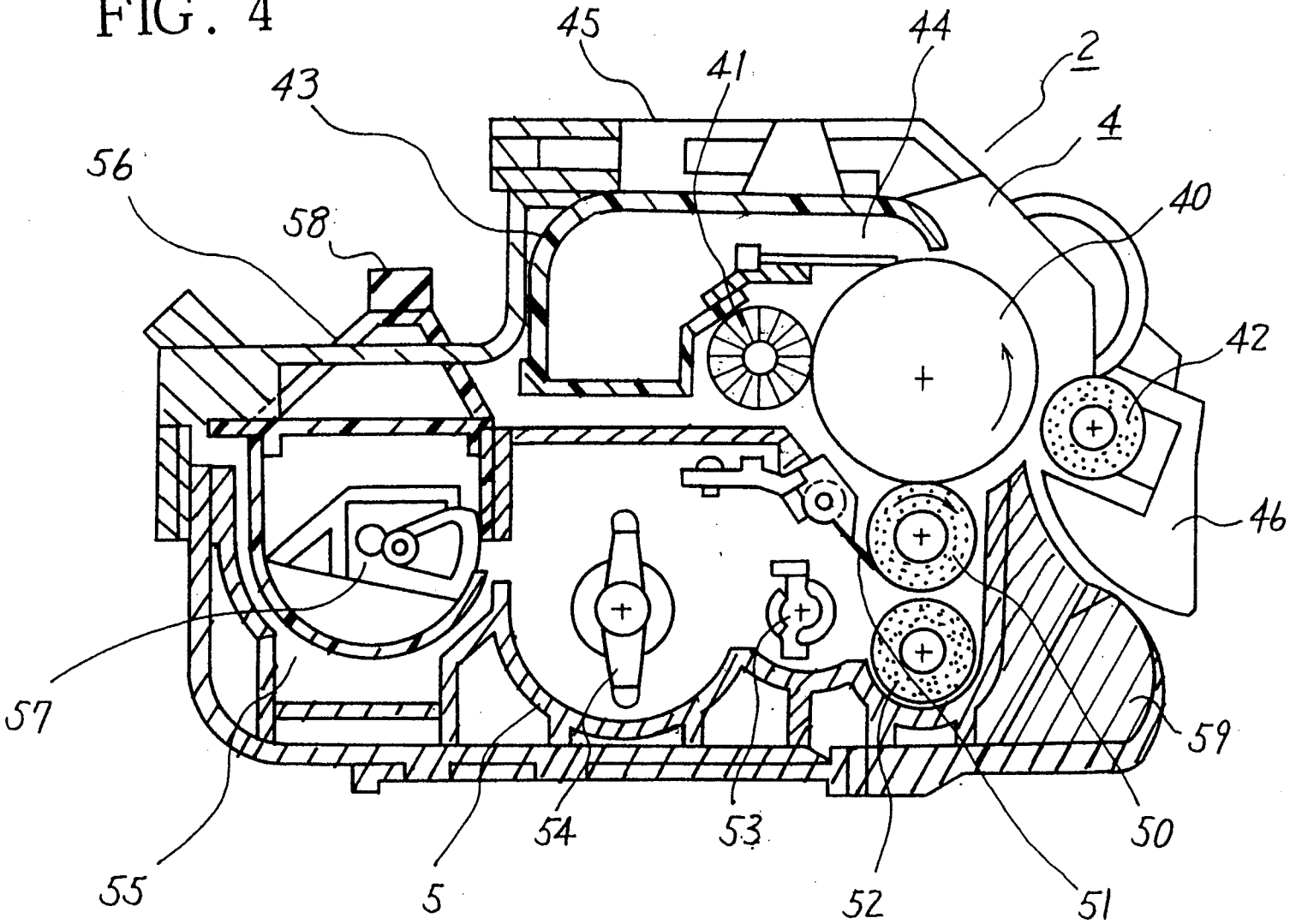
FIG. 4 is a cross section of a process cartridge of the image forming apparatus shown in FIG. 3.
Figure 5:
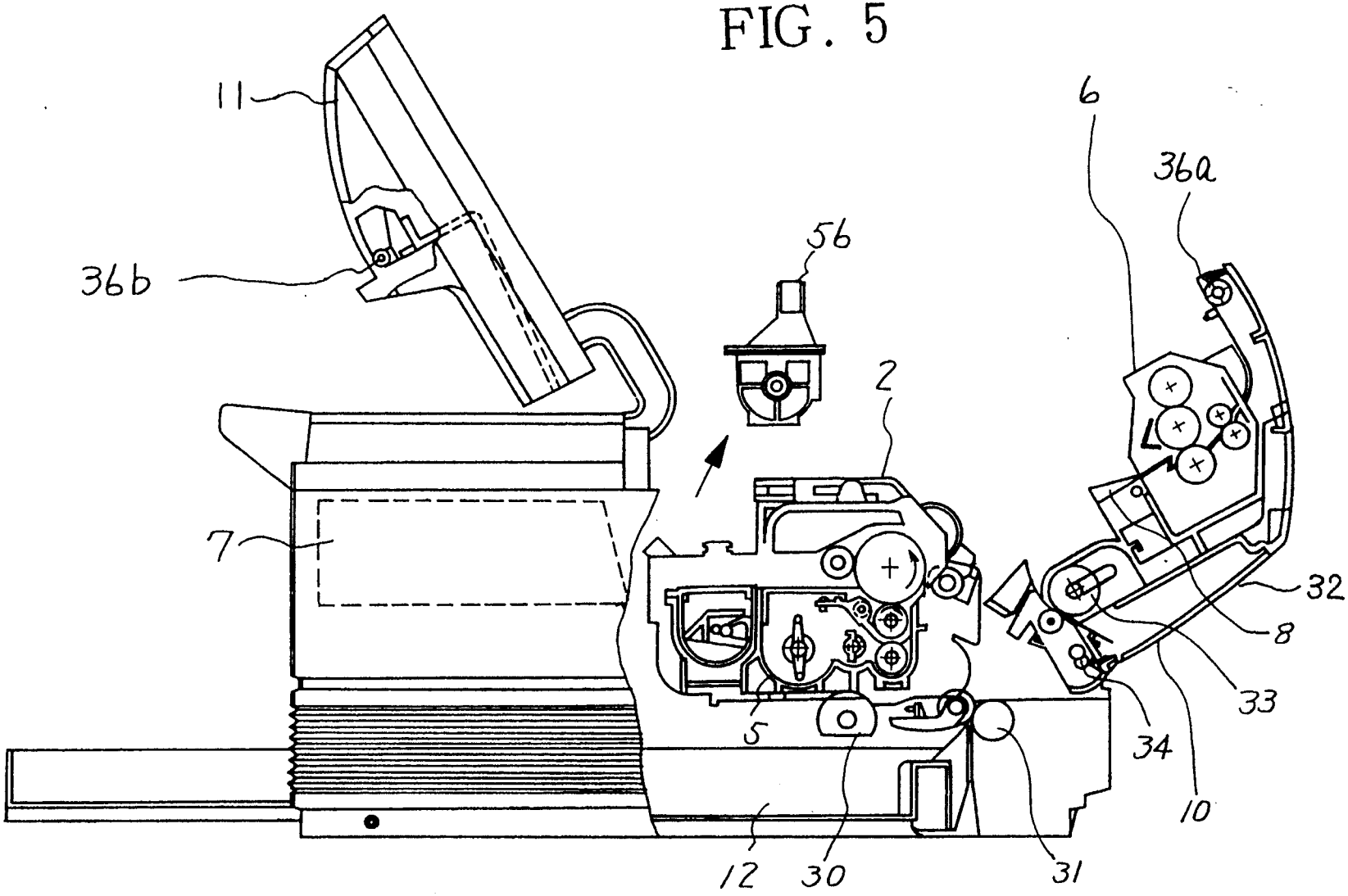
FIG. 5 is a diagram illustrating the image forming apparatus in FIG. 3 with its covers open.
Figure 6A:
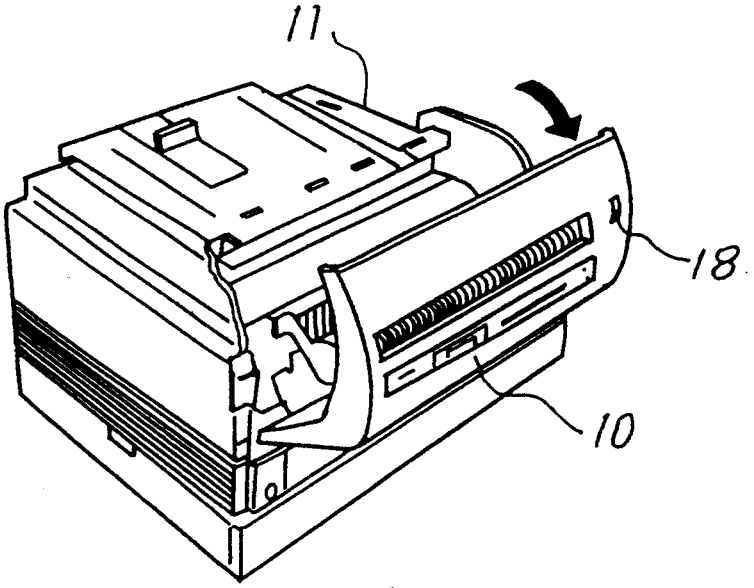
FIGS. 6A and 6B are diagrams illustrating the image forming apparatus shown in FIG. 2 with the covers open.
Figure 6B:
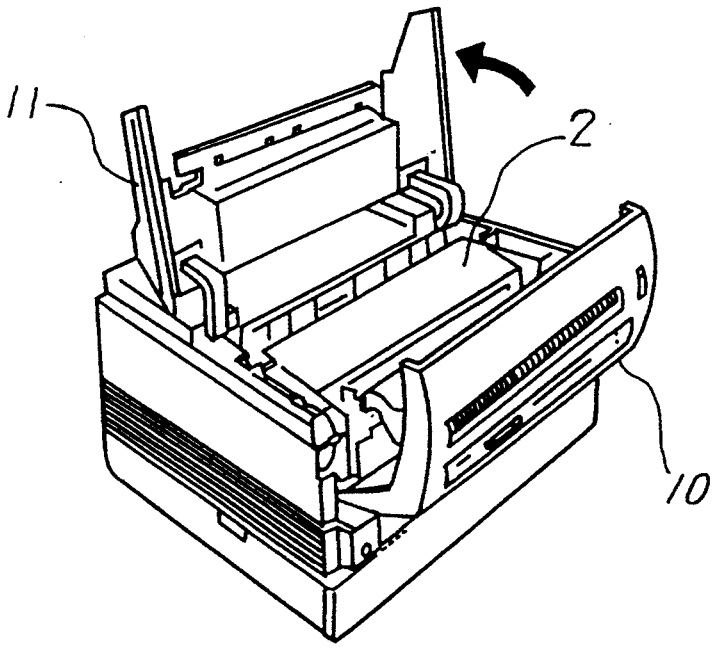
Figure 7:
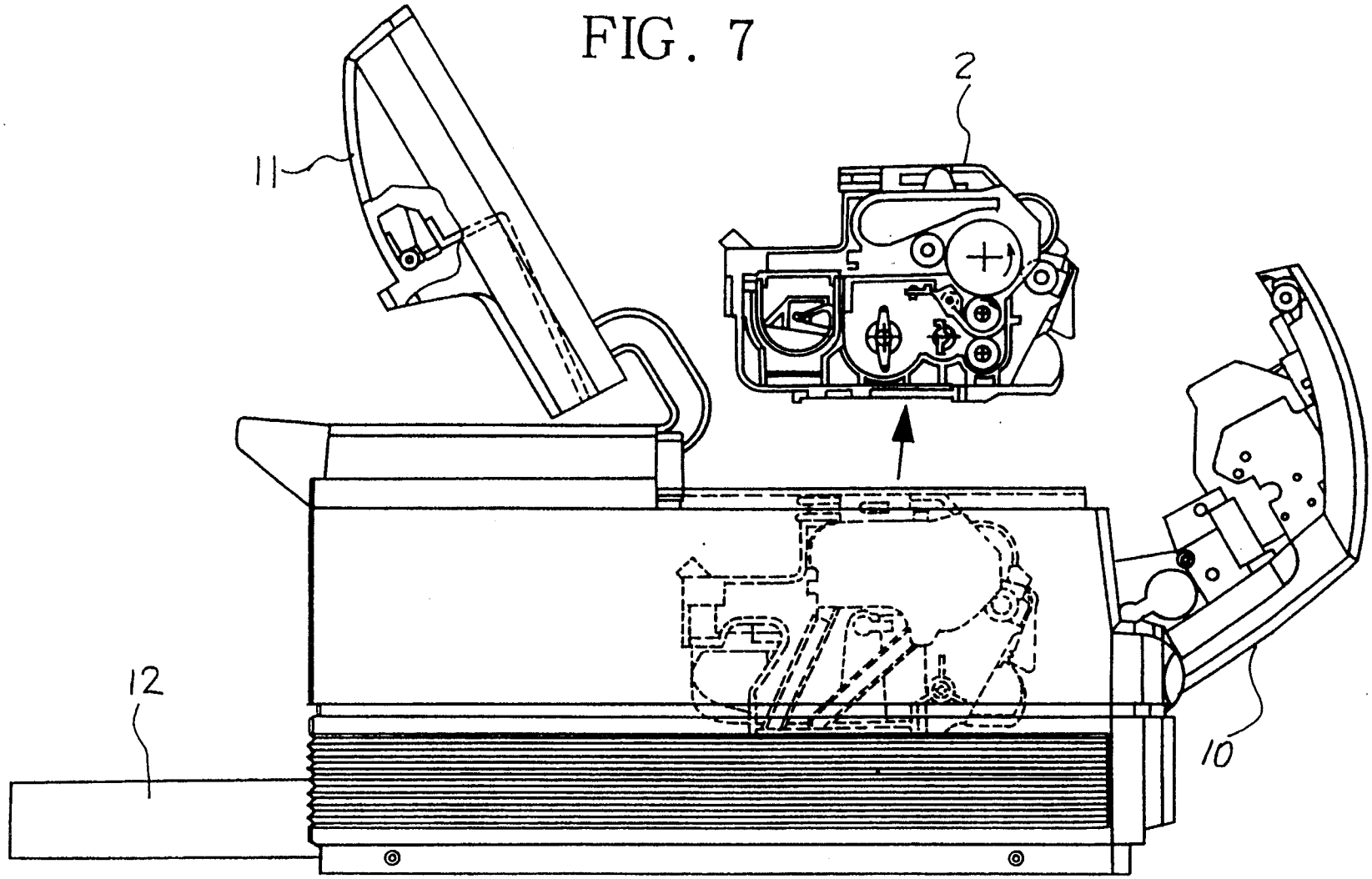
FIG. 7 is a diagram for explaining how to exchange the process cartridge of the image forming apparatus shown in FIG. 3.

FIG. 2 is a perspective view showing the outline of an image forming apparatus according to one embodiment of the present invention, FIG. 3 is a cross-sectional view showing the interior of the image forming apparatus shown in FIG. 2, FIG. 4 presents a cross section of a process cartridge shown in FIG. 3, FIG. 5 illustrates the image forming apparatus in FIG. 3 with its covers open, FIG. 6A is a perspective view of the image forming apparatus with its front cover open, FIG. 6B is a perspective view of the image forming apparatus with its upper cover open, and FIG. 7 illustrates the image forming apparatus with both the front and upper covers open.

The illustrated image forming apparatus is an electrophotographic printer; FIG. 2 is a perspective view of the apparatus as viewed from the front. In FIG. 2, a front cover 10 is opened frontward of the apparatus to open a feeding path 3 shown in FIG. 3. An upper cover 11 covers the top of the apparatus, and is opened upward of the apparatus. When opened, the upper cover 11 opens the top of the apparatus. A sheet cassette 12 is to be set in the apparatus from the front thereof through a cassette inserting port 13. A stacker 14 is provided at the top of the apparatus to receive printed sheets. A sheet guide 15 is provided on the stacker 14 to guide the sheet discharged on the stacker 14. An operation panel 16 is provided at a front cover 10 and has various switches and a display device. A controller box 17 is provided at the bottom of the apparatus and accommodates printer control circuits, etc.

Referring to the cross-sectional view in FIG. 3, an electrophotographic process cartridge 2 is provided above the sheet cassette 12 and will be described later with reference to FIG. 4. A thermal fixing unit 6 causes a sheet to be put through between a heat roller 60 and a backup roller 61 to fix a toner image on that sheet. This thermal fixing unit 6 is provided with a cleaning roller 62 for removing a toner from the heat roller 60. An optical unit 7 uses a polygon mirror to scan the photosensitive drum 40 with a beam from a semiconductor laser, which is driven according to image information, thereby writing an image on the photosensitive drum 40. The light image from the optical unit 7 passes above a developing unit 5 (which will be described referring to FIG. 4) of the process cartridge 2 as indicated by a broken-lined arrow to irradiate the photosensitive drum 40 of the process cartridge 2. A sheet separator 8 has a discharge electrode to apply charges of the opposite polarity to that of the potential at the back of the sheet on which the toner image on the photosensitive drum 40 has been transferred, to that back of the sheet to deelectrify the back of the sheet. This discharge electrode deelectrifies the back of the sheet to separate the sheet from the photosensitive drum 40.

A pickup roller 30 serves to pick up sheets in the sheet cassette 12. A resist roller 31 aligns the leading edge of the sheet picked up by the pickup roller 30, and feeds out the sheet. Reference numeral "32" denotes a manual-insertion guide which guides a manually inserted sheet to a feed roller 33 when opened rightward in FIG. 4. The feed roller 33 feeds the sheet, guided by the manual-insertion guide 32, toward the photosensitive drum 40 of the process cartridge 2. Reference numeral "34" is the rotary shaft of the front cover 10. Discharge rollers 36 are provided at the top portion of the front cover 10 to discharge the sheet, passing through the thermal fixing unit 6, onto the stacker 14.

As shown in the cross-section view in FIG. 4, the process cartridge 2 comprises a drum cartridge 4 and the developing unit 5. The developing unit 5 is attached to the drum cartridge 4 by pins (not shown), and can be separated therefrom by detaching the pins.

The structure of the drum cartridge 4 will now be described. In FIG. 4, the photosensitive drum 40 has an organic photosensitive layer (OPC or the like) formed on the surface of a cylindrical base of aluminum or the like, and is rotatable counterclockwise as shown. A brush charger 41 is constituted by winding a conductive brush, which has conductive rayon fibers woven into the core, around the rotary shaft. The photosensitive drum 40 is uniformly charged to about −600 V by this brush charger 41. A transfer roller is provided at the drum cartridge 4, and is made of a conductive porous rubber material, such as porous polyurethane foam (sponge). This transfer roller 42 is applied with a transfer voltage and is pressed against the photosensitive drum 40 to transfer the toner image on the photosensitive drum 40 onto the sheet. A waste toner box 43 is provided with a scraping blade 44, which scrapes a residual toner off the photosensitive drum 40, so that the box 43 receives the scraped toner. A handle 45 is provided to permit a user to carrying the drum cartridge 4 with a hand. A roller cover 46 serves to be a stopper for the transfer roller 42 and to protect the transfer roller.

The structure of the developing unit 5 will be described next. Referring to FIG. 4, a developing roller 50 is a conductive elastic roller, which is preferably made of a conductive porous rubber material, such as conductive porous polyurethane foam (sponge). The developing roller 50 rotates clockwise as shown in the diagram to feed a non-magnetic, one-component toner to the photosensitive drum 40 while holding the toner with the retentive force of its surface. This developing roller 50 is pressed against the photosensitive drum 50 with a predetermined nip width and is applied with a developing bias voltage of about −300 V. A layer-thickness restricting blade 51, which is made of a 0.1-mm thick stainless plate, serves to restrict the thickness of the toner layer on the developing roller 50 to a predetermined thickness. This layer-thickness restricting blade 51 is pressed against the developing roller 50 and is applied with a negative voltage of about −400 V. This applied voltage allows the layer-thickness restricting blade 51 to supply negative charges to the toner to forcibly charge the toner negatively at the time of restricting the thickness of the toner layer. Accordingly, the toner can be charged stably even under the conditions of high humidity and high temperature. A reset roller 52 is disposed to face the developing roller 50 and rotates in the same direction as the developing roller 50. This reset roller 52 is applied with a bias voltage of −400 V to scrape the toner off the developing roller 50 in the right-hand side of the diagram and supply the toner to the developing roller 50 in the left-hand side of the diagram.

Reference numerals "53" and "54" denote paddle rollers, which rotate to stir the non-magnetic, one-component toner in the developing unit 5 and charge the toner. In addition, the paddle rollers 53 and 54 supply the stirred toner toward the reset roller 52. A toner cassette retainer 55 retains a toner cassette 56, which contains the non-magnetic, one-component toner. This toner cassette 56 is detachably set in the toner cassette retainer 55. A toner supply lever 57 is provided in the toner cassette 56, and rotates to feed the toner in the toner cassette 56 into the developing unit 5. The toner cassette 56 is provided with a handle 58 to allow a user to hold the toner cassette 56 with a hand. A sheet guide rib 59 is provided below the roller cover 46. This sheet guide rib 59, together with the roller cover 46, forms a path for guiding the sheet between the photosensitive drum 40 and the transfer roller 42.

A U-shaped feeding path 3 is formed, which extends fro m the sheet cassette 12 and reaches the discharge rollers 36 through the process cartridge 2.

The function of this printer will be described referring to FIGS. 2 through 4. A sheet in the sheet cassette 12 is picked up by the pickup roller 30 and abuts against the resist roller 31. After the leading edge is aligned by the resist roller 31, this sheet is fed toward the photosensitive drum 40 along a U-shaped feeding path 3. Meantime, when the picked sheet reaches the resist roller 31, the optical unit 7 starts exposing the photosensitive drum 40 to image light. As a result, the potential of the image-exposed portion of the photosensitive drum 40, which has been charged to −600 V by the brush charger 41 becomes zero, thus forming an electrostatic latent image corresponding to the image to be copied.

As a bias voltage of −300 V is applied to the developing roller 50 in the developing unit 5, the negatively charged toner sticks on the image-exposed portion of zero potential of the photosensitive drum 40, forming a toner image thereon. The toner image on the photosensitive drum 40 is transferred onto the sheet, fed by the resist roller 31, by the transfer roller 42 due to the electrostatic force and pressure. The back of the sheet that is electrostatically adsorbed to the photosensitive drum 40 is deelectrified by the charges supplied by the sheet separator 8, so that this sheet is separated from the photosensitive drum 40. The separated sheet is fed to the thermal fixing unit 6 where the toner image on the sheet is thermally fixed by the heat roller 60. The image-fixed sheet is then discharged on the stacker 14 by the discharge rollers 36.

A sheet manually inserted through the manual-insertion guide 32 pulled open is likewise conveyed toward the photosensitive drum 40 by the feed roller 33. The toner image on the photosensitive drum 40 is transferred onto that sheet by the transfer roller 42 due to the electrostatic force and pressure. The back of the sheet that is electrostatically adsorbed to the photosensitive drum 40 is deelectrified by the charges supplied by the sheet separator 8, so that this sheet is separated from the photosensitive drum 40. The separated sheet is then fed to the thermal fixing unit 6 where the toner image on the sheet is thermally fixed by the heat roller 60. The resultant sheet is then discharged on the stacker 14 by the discharge rollers 36.

In the diagram of FIG. 5 which illustrates the front cover and upper cover of the apparatus opened, the front cover 10 is opened frontward (rightward in the diagram) around the cover rotary shaft 34. Provided on this front cover 10 are the manual-insertion guide 32, the feed roller 33, the sheet separator 8, the thermal fixing unit 6 and an upper discharge (drive) roller **36*a* of the discharge roller pair 36. The upper cover 11 is opened upward of the apparatus (upward in the diagram) around a rotary shaft (not shown). A lower discharge (pinch) roller 36*b* of the discharge roller pair 36 is provided on the upper cover 11**.

When the front cover 10 is opened by unlocking a lock lever 18 of the front cover 10, as shown in FIGS. 5 and 6A, the U-shaped feeding path 3 extending from the resist roller 31 to the discharge rollers 36 is opened, making it easier to remove any jammed sheet. If the transfer roller 42 is shifted from the proper position facing the photosensitive drum 40, i.e., if there is a shift in parallelism and position to the photosensitive drum 40, image transfer cannot be executed properly. In this respect, the transfer roller 42 is provided on the process cartridge 2. Although this design does not open the space between the photosensitive drum 40 and the transfer roller 42, a jammed sheet can easily be removed without any problem even if that portion does not become free.

The reason why the whole thermal fixing unit 6 is provided on the front cover 10 is that if the thermal fixing unit 6 were divided to open the feeding path, a part of the thermal fixing unit should be provided on the process cartridge 2, thus inconveniencing a user to remove the process cartridge 2. Although this design does not open the space between the heat roller 60 of the thermal fixing unit 6 and the backup roller 61, a jammed sheet can easily be removed without any problem even if that portion does not become free.

The front cover 10 is provided above the upper cover 11 at the sheet discharging portion so that the upper cover 11 does not become free unless the front cover 10 is opened as shown in FIG. 2. When the front cover 10 is opened and the upper cover 11 is opened next as shown in FIG. 6B, therefore, the top portion of the apparatus and part of the front portion of the apparatus are opened as shown in FIG. 5. Accordingly, the toner cassette 56 can easily be removed or attached from the front side of the apparatus while keeping the process cartridge 2 installed in the apparatus, thus allowing for the exchange of the toner cassette 56 alone.

As the front side of the apparatus is opened by opening the front cover 10 and the top portion of the apparatus is opened by opening the upper cover 11 as shown in FIG. 7, the attachment and detachment of the process cartridge 2 can also be performed easily. Even if the process cartridge 2 is large, therefore, the exchange of the process cartridge 2 is easy. In other words, the process cartridge 2 can be designed large, particularly, the developing unit 5 in the process cartridge 2 can be designed large, so that the quantity of the retainable developer can be increased, thus making the exchanging cycle of the developing unit 5 significantly long.

Further, since the developer can be supplemented through the exchange of the toner cassette 56 alone, the exchanging cycle of the developing unit 5 can be made longer. Furthermore, as the covers 10 and 11 are opened with the discharge rollers 36 separated into upper and lower rollers, the entire U-shaped feeding path 3 can be opened, thus facilitating removal of a jammed sheet.

Figure 8:
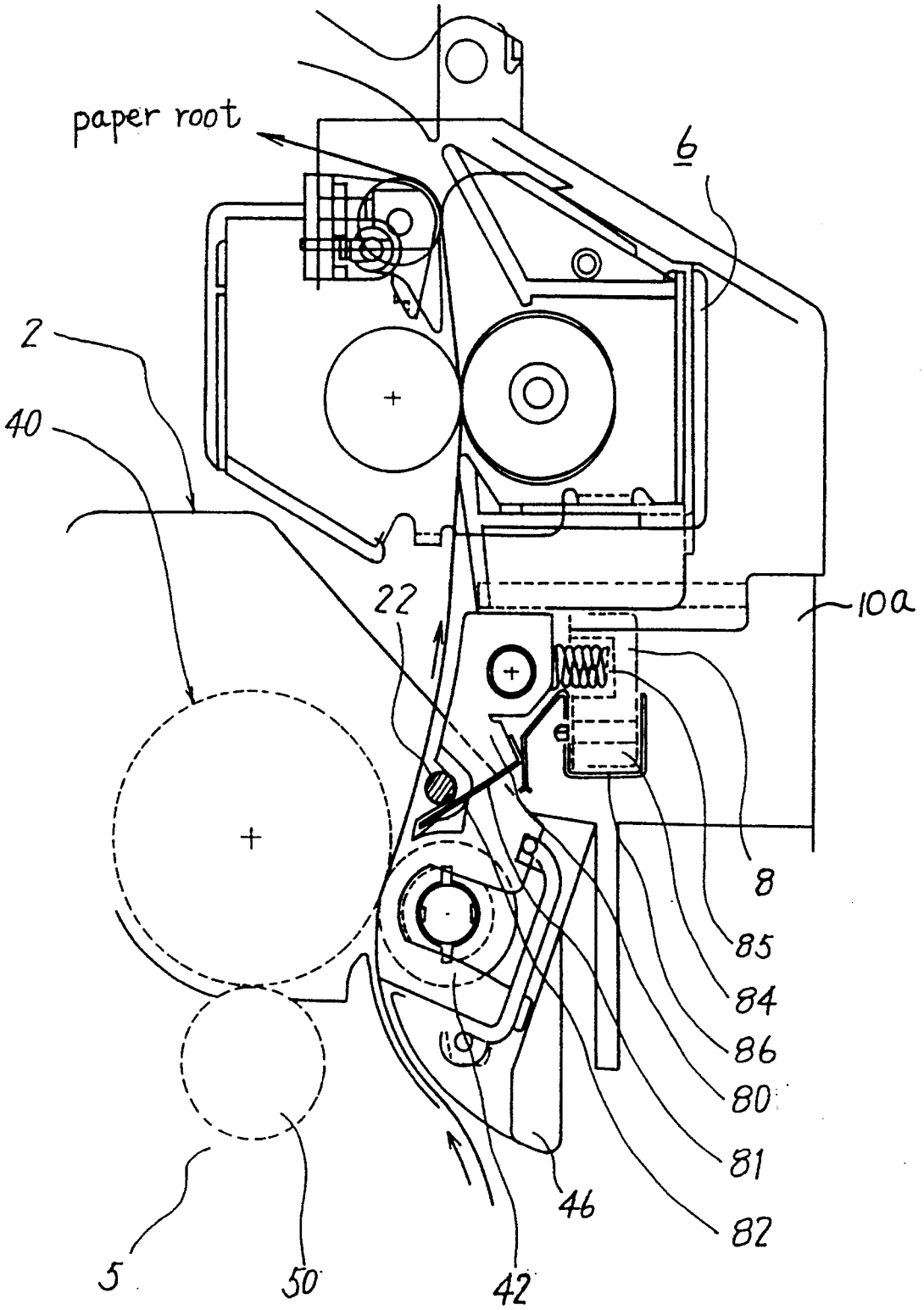
FIG. 8 is a diagram showing the relationship between separation means and a photosensitive drum when the covers of the image forming apparatus in FIG. 3 are closed.
Figure 11:
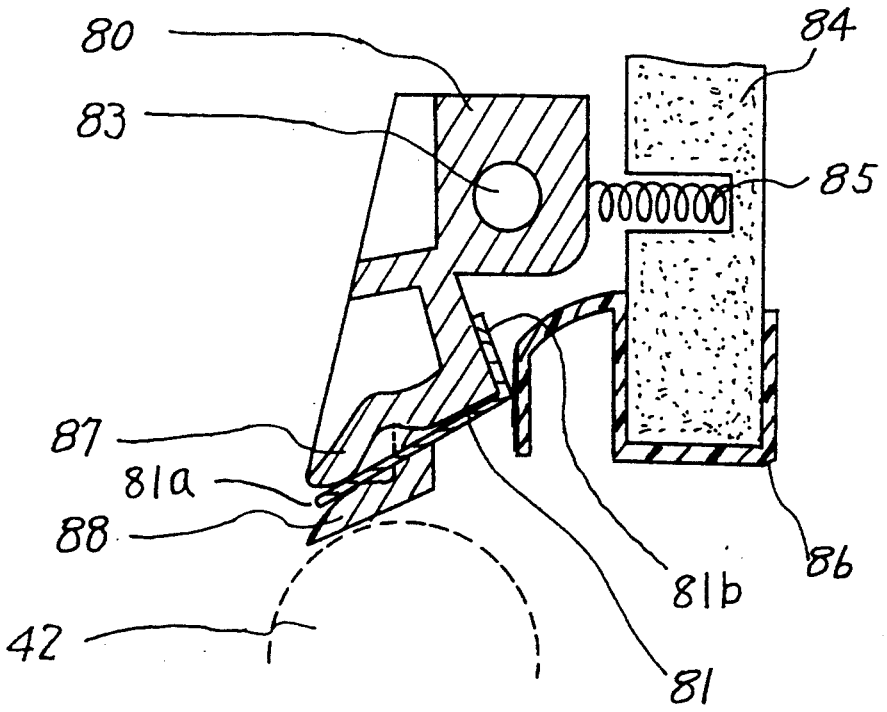
FIG. 11 is a cross-sectional view of the separation means in FIG. 10.
Figure 12:
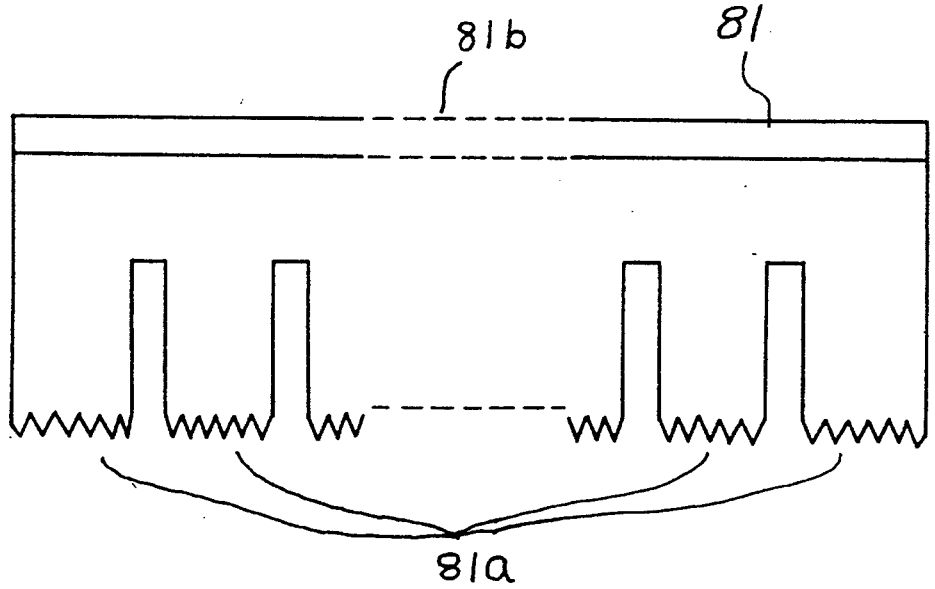
FIG. 12 is a diagram showing the structure of a discharge electrode shown in FIG. 10.

The structure of the sheet separator 8 will now be described. FIG. 8 is a diagram showing the relationship between the photosensitive drum and the sheet separator when the front cover is closed, FIG. 9 is a diagram showing the structure of the positioning members of the process cartridge, FIG. 10 is a perspective view of the sheet separator in FIG. 8, FIG. 11 is a cross section of the sheet separator in FIG. 8, and FIG. 12 is a top view of a discharge electrode shown in FIG. 10.

Figure 9:
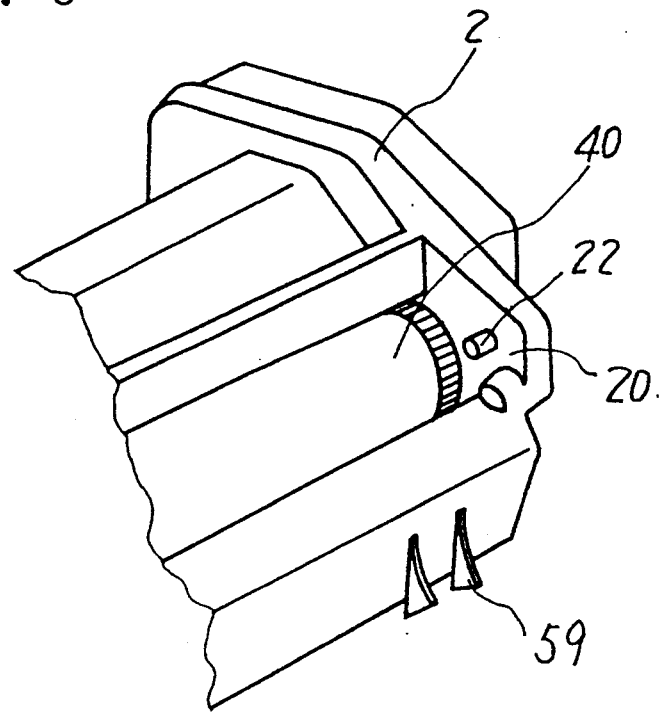
FIG. 9 is a diagram for explaining positioning members of the process cartridge in FIG. 8.

As shown in FIGS. 8 and 9, the process cartridge 2 has a unit frame 20 on each side, to which the aforementioned photosensitive drum 40, transfer roller 42, developer unit 5, brush charger 41 and waste toner box 43 are attached. A positioning pin 22 is provided on this unit frame 20 at a predetermined position from where the photosensitive drum 40 is mounted.

A description will now be given of the sheet separator 8 provided on the front cover 10. In FIGS. 10 and 11, a sheet guide 80, made of an insulating resin, has a shape to guide a sheet and supports a discharge electrode 81 which will be described later. The discharge electrode 81 is designed to have an L-shaped cross section as shown in FIG. 11, and has a distal end **81*a* formed to have a shape of sawteeth as shown in FIG. 12. This sawtooth-shaped distal end 81*a* of the discharge electrode 81** forms multiple needle electrodes.

Figure 10:
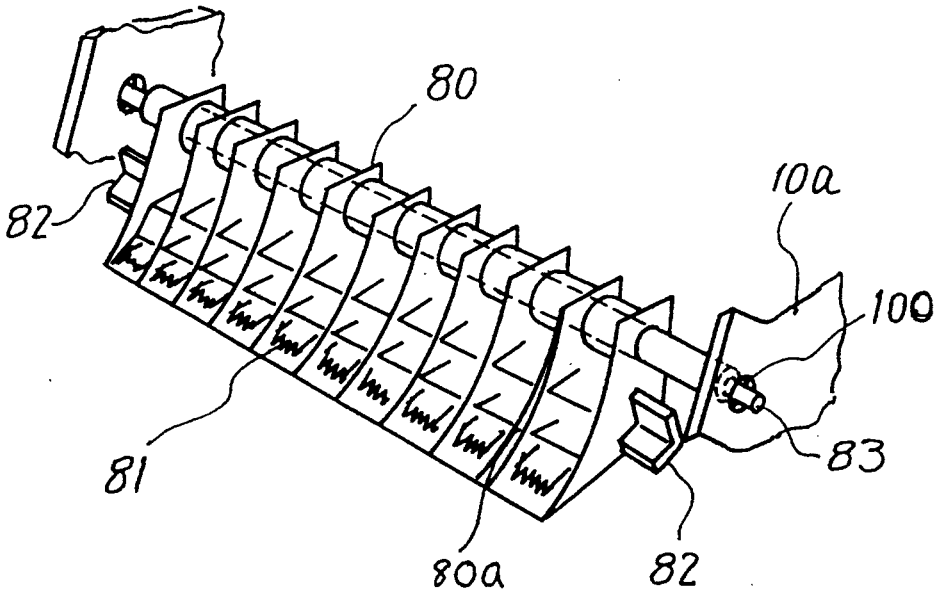
FIG. 10 is a perspective view of the separation means in FIG. 8.

As shown in FIG. 10, a positioning rib 82 is provided on either side of the sheet guide 80 and has an L shape. A rotary shaft 83, which is made of a rigid member such as a metal shaft, is put through the sheet guide 80 as shown in FIG. 10. Guide ribs 87 and 88 constitute a reinforced portion for linking individual sheet guide portions **80*a* of the sheet guide 80, and the discharge electrode 81 is inserted and held between the guide ribs 87 and 88**.

A stationary block 84, made of an insulating resin, is securely provided on the front cover 10, as shown in FIG. 11. A coil spring 85 is provided in the stationary block 84 as shown in FIG. 11 to urge that portion of the sheet guide 80 which corresponds to the position of the rotary shaft 83. A leaf spring 86 is provided on the stationary block 84 in such a way as to contact a terminal portion **81*b* of the discharge electrode 81 of the sheet guide 80. This leaf spring 86 pushes the discharge electrode 81 and forms a conductive path for the discharge electrode 81 while in contact with the electrode 81**.

In FIG. 10, a frame **10*a* of the front cover 10 has a support hole 100 where the rotary shaft 83 of the sheet guide 80 is inserted. This support hole 100 has a diameter slightly larger (by about 1 mm) than the diameter of the rotary shaft 83. Therefore, the rotary shaft 83 can move within the support hole 100**.

As shown in FIG. 11, the discharge electrode 81 is inserted between the guide ribs 87 and 88 of the sheet guide 80. Then, the end portion of the rotary shaft 83 of the sheet guide 80 is fitted in the support hole 100 of the unit frame **10*a* as shown in FIG. 10, yielding the state as shown in FIGS. 8 and 11. In this state, as the rotary shaft 83 is supported rotatable in the support hole 100 of the unit frame 10*a*, the sheet guide 80 is movable in the right and left directions in the diagrams and thus has some degree of freedom. The sheet guide 80 is also rotatable around the rotary shaft 83. That is, the sheet guide 80, which supports the discharge electrode 81, is movable with respect to the frame 10*a* of the front cover 10**.

Further, that portion of the sheet guide 80 which corresponds to the location of the rotary shaft 83 is urged by the coil spring 85 of the stationary block 84, and the lower portion of the sheet guide 80 is urged by the leaf spring 86 of the stationary block 84.

The reason why the sheet separator 8 is designed to be movable is that as the transfer unit 42 is provided in the process cartridge 2 on which the photosensitive drum 40 is mounted, the sheet separator 8 should be positioned independently with respect to the photosensitive drum 40 in accordance with the opening/closing of the front cover 10.

The sheet separator 8 in use is of a type which uses the discharge electrode 81 for a discharge operation because this type can discharge with a lower voltage than the one which uses a corona wire. In consideration of sheet separation, it is desirable that electric charges for sheet separation be supplied to the vicinity of the transfer position. When the transfer roller 42 is used in the transfer unit, the transfer roller 42 interferes with the operation of a separation charger, thus disabling the supply of electric charges to the aforementioned vicinity of the transfer position. As the discharge electrode 81 discharges from its distal end, the distal end of the electrode 81 has only to be located in the vicinity of the transfer position. Even with the use of the transfer roller 42, therefore, the discharge electrode 81 can supply electric charges to the vicinity of the transfer position. Further, as the discharge electrode 81 discharges with a low voltage, it can be disposed near the transfer roller 42. it is therefore possible to position the distal end 81*a* of the electrode 81 closer to the vicinity of the transfer position.

To separate a sheet from the photosensitive drum 40, the discharge electrode 81 may be grounded to remove the electric charges from the back of the sheet. But this method has a low efficiency of sheet separation. Accordingly, a voltage is applied to the discharge electrode 81 so that the electrode 81 supplies electric charges of the opposite polarity to that of the electric charges on the back of the sheet. This can positively remove electric charges from the back of the sheet, thus improving the sheet separating efficiency.

Figure 13:
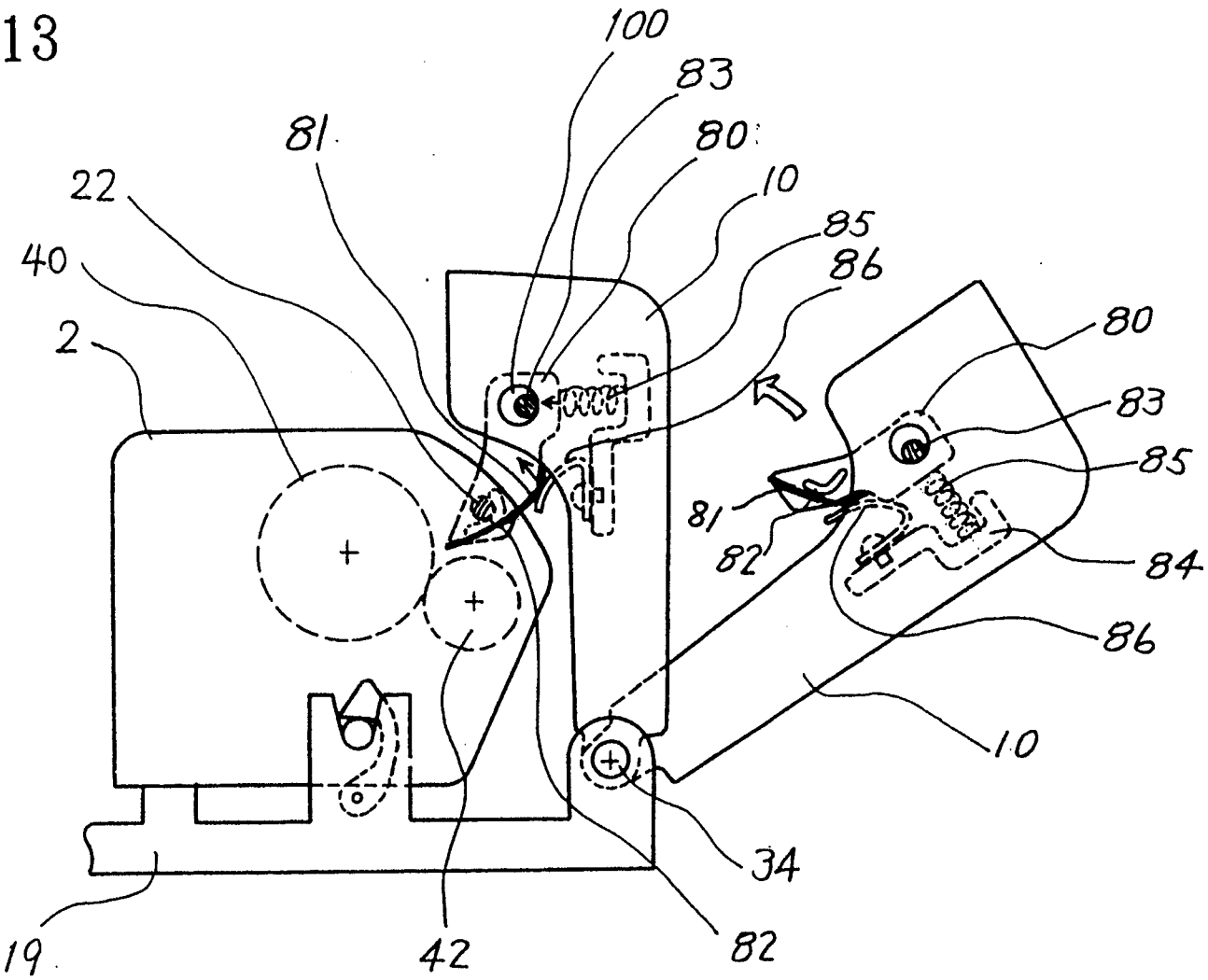
FIG. 13 is a diagram for explaining the positioning operation of the separation means when the covers are closed.

The aforementioned positioning of the discharge electrode 81 will now be described below. As shown in FIG. 13, when the front cover 10 is closed from the open state, the positioning ribs 82 of the sheet guide 80 abut against the associated positioning pins 22 of the frame 20 of the process cartridge 2. As a result, the sheet guide 80 is positioned at a predetermined position with respect to the process cartridge 2, as shown in FIGS. 8 and 13.

The discharge electrode 81 of the sheet guide 80 is provided at a predetermined position of the sheet guide 80, while the positioning pins 22 are provided on the frame 20 at a predetermined distance from the photosensitive drum 40. Therefore, the engagement of the positioning pins 22 with the associated positioning ribs 82 can ensure a constant gap between the photosensitive drum 40 and the distal end 81*a* of the discharge electrode 81 and a constant direction of the discharge electrode 81 with respect to the photosensitive drum 40.

The size precision of the front cover 10 does not therefore affect the positional relationship between the photosensitive drum 40 and discharge electrode 81. Even when the front cover 10 is closed, therefore, the positional relationship between the photosensitive drum 40 and the distal end 81*a* of the discharge electrode 81 becomes constant. Thus, the front cover 10 need not have a high size precision, so that an inexpensive resin or the like can be used for the front cover 10. In addition, it is possible to eliminate the need for accurately adjusting the positional precision of the front cover 10.

As the support portion for the discharge electrode 81 is accomplished by the sheet guide 80, this support portion can also serve as the sheet guide. Since the discharge electrode 81 is held between the guide ribs 87 and 88 which are the reinforced members for the sheet guide 80, the electrode holding structure becomes simpler and the attachment of the discharge electrode 81 becomes easier. Further, the lower guide rib 88 can prevent a leak between the transfer roller 42 and discharge electrode 81 as shown in FIG. 11. Even when the distal end 81*a* of the discharge electrode 81 is positioned closer to the transfer roller 42, therefore, stable sheet separation is possible.

Furthermore, the coil spring 85 and leaf spring 86, which help the positioning function of the sheet guide 80, are provided, so that the sheet guide 80 is held at a constant position by the above-described positioning function. In addition, the leaf spring 86 contacts the rear end 81*b* of the discharge electrode 81. As a discharge voltage is applied to the leaf spring 86 provided on the frame 10*a*, the discharge voltage is transmitted to the discharge electrode 81, thus enabling the discharge action. In other words, the leaf spring 86 forms a conductive path for the discharge electrode 81, thus simplifying the structure and making it possible to reduce the number of the required components.

As the hole 100 of the front frame 10*a* is made large, the sheet guide 80 can be given some degree of freedom in the left and right directions. Further, the sheet guide 80 can rotate around the rotary shaft 83 and thus has some degree of freedom in the rotational direction. It is therefore possible to accomplish a movable floating structure with a simple structure.

Furthermore, the positioning pins 22 are provided on the exchangeable process cartridge 2, the position of the distal end 81*a* of the discharge electrode 81 can be controlled to be constant with respect to the photosensitive drum 40 of the process cartridge 2 whose position to the apparatus changes when exchanged. That is, even when the process cartridge 2 is exchanged with another one, the positional relationship between the photosensitive drum 40 and the distal end 81*a* of the discharge electrode 81 can always be kept with a high precision.

Further, the rotary shaft 83 of the sheet guide 80 is made of a rigid member. Even if the sheet guide 80 is made of an inexpensive material such as a resin, the deformation of the sheet guide 80 can be corrected and the sheet guide 80 can be manufactured at a low cost.

The present invention is not limited to the above embodiment, but may be modified in various manners as follows. First, although the process cartridge 2 has been explained as an electrophotographing mechanism which performs charging, exposure and developing operation in the foregoing description, this invention may be applicable to other types of recording systems, such as an electrostatic recording system which simultaneously performs the formation of an electrostatic latent image and the developing of this electrostatic latent image or an electrostatic recording system, which transfers a toner image after developing the electrostatic latent image. Secondly, although the process cartridge 2 is exchangeable by a user, this invention is applicable to an image forming apparatus which does not allow the user to exchange the process unit. Thirdly, although the sheet separator 8 is provided on the front cover 10 that is open frontward, it may also be provided on the cover which opens upward, the cover which opens downward, or the like. Fourthly, also the sheet separator 8 has been explained as the discharge electrode 81, other discharge means such as a corotron may be used as well. Fifthly, the type of sheets are not limited to paper, and other media may be used as well. Sixthly, although the image forming apparatus has been explained as a printer, it may be a different type of image forming apparatus, such as a copying machine or facsimile. Seventhly, although the developing unit uses a non-magnetic, one-component developer in the foregoing description, it may use another known type of developer, such as a magnetic, one-component developer or a magnetic, two-component developer.

In short, according to the present invention, the separation means has a floating structure designed to be movable and the positioning members 22 are provided on the main body frame on which the latent image carrier is provided, so that the separation means is positioned by the positioning members. It is therefore possible to significantly improve the precision of the gap distance between the latent image carrier and separation means. Further, even when the frame is made of plastic or the like which is inexpensive, the gap precision can be improved, thus ensuring a low-cost and light image forming apparatus.

What is claimed is:

1. An image forming apparatus comprising:

a feeding path for feeding a sheet on which an image is to be formed;

an endless latent image carrier;

image forming means for forming a toner image on the latent image carrier;

transfer means for transferring the toner image on the latent image carrier onto the sheet that is conveyed in the feeding path;

separation means for supplying electric charges of an opposite polarity to that of electric charges on a back of the sheet to the back of the sheet in the feeding path at a position downstream of the transfer means, thereby separating the sheet from the latent image carrier;

an openable and closable frame on which at least the separation means is movably provided and which is to be opened to free the feeding path;

a positioning member for positioning the separation means by engagement with the separation means when the frame is closed; and a main body frame on which at least the latent image carrier, the transfer means, and the positioning member are provided so that the positioning member is provided on the main body at a predetermined distance from the latent image carrier.

2. The image forming apparatus according to claim 1, wherein the separation means has a discharge electrode for generating the electric charges of the opposite polarity, an insulating support block for supporting the discharge electrode, and a positioning rib provided on the support block and engageable with the positioning member.

3. The image forming apparatus according to claim 2, further comprising guide ribs, provided on the support. block, for holding and supporting the discharge electrode.

4. The image forming apparatus according to claim 2, wherein the transfer means is constituted of a transfer roller.

5. The image forming apparatus according to claim 1, wherein the transfer means is a transfer roller, and wherein the separation means is a discharge electrode.

6. An image forming apparatus comprising:

a feeding path for feeding a sheet on which an image is to be formed;

an endless latent image carrier;

image forming means for forming a toner image on the latent image carrier;

transfer means for transferring the toner image on the latent image carrier onto the sheet that is conveyed in the feeding path;

separation means for supplying electric charges of an opposite polarity to that of electric charges on a back of the sheet to the back of the sheet in the feeding path at a position downstream of the transfer means, thereby separating the sheet from the latent image carrier, wherein said separation means has a discharge electrode for generating the electric charges of the opposite polarity, and insulating support block for supporting the discharge electrode, and a positioning rib provided on the support block and engageable with the positioning member;

an openable and closable frame on which at least the separation means is movably provided and which is to be opened to free the feeding path;

a main body frame on which at least the latent image carrier is provided;

a positioning member, provided on the main body frame, for positioning the separation means by engagement with the separation means when the frame is closed;

a rotary shaft provided in the support block; and a support hole, formed in the frame, for supporting the rotary shaft when inserted in the support hole.

7. The image forming apparatus according to claim 6, further comprising a spring member, provided on the openable and closable frame, for urging the support block.

8. The image forming apparatus according to claim 7, wherein the discharge electrode has an end portion exposed from the support block and connected to the spring member, the end portion forming a conductive path.

9. The image forming apparatus according to claim 7, wherein the support hole has a diameter larger than that of the rotary shaft so as to permit the rotary shaft to be movable in the support hole.

10. The image forming apparatus according to claim 9, wherein the rotary shaft is made of a rigid member.

11. The image forming apparatus according to claim 7, wherein the rotary shaft is made of a rigid member.

12. The image forming apparatus according to claim 6, wherein the support hole has a diameter larger than that of the rotary shaft so as to permit the rotary shaft to be movable in the support hole.

13. The image forming apparatus according to claim 12, wherein the rotary shaft is made of a rigid member.

14. The image forming apparatus according to claim 6, wherein the rotary shaft is made of a rigid member.

15. An image forming apparatus comprising:

a feeding path for feeding a sheet on which an image is to be formed;

an endless latent image carrier;

image forming means for forming a toner image on the latent image carrier;

transfer means for transferring the toner image on the latent image carrier onto the sheet that is conveyed in the feeding path;

separation means for supplying electric charges of an opposite polarity to that of electric charges on a back of the sheet to the back of the sheet in the feeding path at a position downstream of the transfer means, thereby separating the sheet from the latent image carrier;

an openable and closeable frame on which at lest the separation means is movably provided and which is to be opened to free the feeding path;

a positioning member for positioning the separation means by engagement with the separation means when the frame is closed; and a process cartridge on which at least the latent image carrier, the transfer means, and the positioning member are provided and which is detachably attached to the image forming apparatus so that the positioning member is provided on the process cartridge at a predetermined distance from the latent image carrier.

16. The image forming apparatus according to claim 15, wherein the separation means has a discharge electrode for generating the electric charges of the opposite polarity, an insulating support block for supporting the discharge electrode, and a positioning rib provided on the support block and engageable with the positioning member.

17. The image forming apparatus according to claim 16, further comprising guide ribs, provided on the support block, for holding and supporting the discharge electrode.

18. The image forming apparatus according to claim 16, wherein the transfer means is constituted of a transfer roller.

19. The image forming apparatus according to claim 18, wherein the transfer roller is provided in the process cartridge.

20. The image forming apparatus according to claim 16, wherein the frame constitutes a frame of a front cover openable frontward of the image forming apparatus.

21. An image forming apparatus comprising:

a feeding path for feeding a sheet on which an image is to be formed;

an endless latent image carrier;

image forming means for forming a toner image on the latent image carrier;

transfer means for transferring the toner image on the latent image carrier onto the sheet that is conveyed in the feeding path;

separation means for supplying electric charges of an opposite polarity to that of electric charges on a back of the sheet to the back of the sheet in the feeding path at a position downstream of the transfer means, thereby separating the sheet from the latent image carrier, wherein the separation means has a discharge electrode for generating the electric charges of the opposite polarity, and insulating support block for supporting the discharge electrode, and a positioning rib provided on the support block and engageable with the positioning member;

an openable and closeable frame on which at least the separation means is movably provided and which is to be opened to free the feeding path;

a process cartridge on which at least the latent image carrier is provided and which is detachably attached to the image forming apparatus;

a positioning member, provided on the process cartridge, for positioning the separation means by engagement with the separation means when the frame is closed;

a rotary shaft provided in the support block; and a support hole, formed int the frame for supporting the rotary shaft when inserted in the support hole.

22. The image forming apparatus according to claim 21, further comprising a spring member, provided on the frame, for urging the support block.

23. The image forming apparatus according to claim 22, wherein the discharge electrode has an end portion exposed from the support block and connected to the spring member, the end portion forming a conductive path.

24. The image forming apparatus according to claim 22, wherein the support hole has a diameter larger than that of the rotary shaft so as to permit the rotary shaft to be movable in the support hole.

25. The image forming apparatus according to claim 24, wherein the rotary shaft is made of a rigid member.

26. The image forming apparatus according to claim 22, wherein the rotary shaft is made of a rigid member.

27. The image forming apparatus according to claim 21, wherein the support hole has a diameter larger than that of the rotary shaft so as to permit the rotary shaft to be movable in the support hole.

28. The image forming apparatus according to claim 27, wherein the rotary shaft is made of a rigid member.

29. The image forming apparatus according to claim 21, wherein the rotary shaft is made of a rigid member.

30. An image forming apparatus comprising:

a feeding path for feeding a sheet on which an image is to be formed;

an endless latent image carrier;

image forming means for forming a toner image on the latent image carrier;

a transfer roller for transferring the toner image on the latent image carrier onto the sheet that is conveyed in the feeding path;

a discharge electrode for supplying electric charges of an opposite polarity to that of electric charges on a back of the sheet to the back of the sheet in the feeding path at a position downstream of the transfer means, thereby separating the sheet from the latent image carrier;

an openable and closable frame on which at least the separation means is movably provided and which is to be opened to free the feeding path;

a positioning member for positioning the separation means by engagement with the separation means when the frame is closed; and a process cartridge on which at least the latent image carrier and the positioning member are provided, and which is detachably attached to the image forming apparatus so that the positioning member is provided on the process cartridge at a predetermined distance from the image carrier.

* * * * *